US005704320A

United States Patent [19]

Ban et al.

[11] Patent Number: 5,704,320

[45] Date of Patent: Jan. 6, 1998

[54] VISCOUS FLUID TYPE HEAT GENERATOR WITH AN ELONGATED ROTOR ELEMENT

[75] Inventors: Takashi Ban; Hidefumi Mori; Yagi Kiyoshi, all of Kariya, Japan

[73] Assignee: Kabushiki Kaisha Toyoda Jidoshokki Seisakusho, Kariya, Japan

[21] Appl. No.: 739,172

[22] Filed: Oct. 30, 1996

[30] Foreign Application Priority Data

Nov. 2, 1995 [JP] Japan ..... 7-286153

[51] Int. Cl.[6] ..... F02N 17/02; F22B 3/06; F24C 9/00

[52] U.S. Cl. ..... 123/142.5 R; 122/26; 126/247

[58] Field of Search ..... 123/142.5 R; 122/26; 126/247

[56] References Cited

U.S. PATENT DOCUMENTS

| | | | |
|---|---|---|---|
| 4,143,639 | 3/1979 | Frenette | 126/247 |
| 4,424,797 | 1/1984 | Perkins | 122/26 |
| 4,685,443 | 8/1987 | McMurtry | 126/247 |
| 4,773,388 | 9/1988 | Herbulot et al. | 126/247 |
| 4,993,377 | 2/1991 | Itakura . | |
| 5,392,737 | 2/1995 | Newman, Sr. et al. | 126/247 |
| 5,577,467 | 11/1996 | Bormann | 126/247 |

FOREIGN PATENT DOCUMENTS 4-11716 1/1992 Japan .

*Primary Examiner*—Erick R. Solis
*Attorney, Agent, or Firm*—Burgess, Ryan & Wayne

[57] ABSTRACT

A viscous fluid type heat generator adopted for being incorporated in a heating system of an automobile has a generally cylindrical hollow housing assembly in which a rotor element in the shape of an axially elongated hollow cylindrical element is rotatably received by being supported on a rotating drive shaft. The elongated rotor element has an outer circumference and end faces to cooperate with an inner wall of the housing assembly to define a heat generating chamber filled with viscous fluid, and a spiral heat receiving chamber hermetically separated from the heat generating chamber and permitting heat exchanging liquid to spirally flow therein to thereby receive heat from the heat generating chamber. The outer circumference of the elongated rotor element has a radius R and an axial length L designed so as to have such a relationship that L is larger than R.

14 Claims, 2 Drawing Sheets

VISCOUS FLUID TYPE HEAT GENERATOR WITH AN ELONGATED ROTOR ELEMENT

BACKGROUND OF THE INVENTION

1. Field of the Invention

The present invention relates to a viscous fluid type heat generator of the type in which viscous fluid confined in a closed space is subjected to a shearing action by a rotating body, i.e., a rotor element, so as to generate heat to be absorbed by a heat exchanging liquid, typically water, flowing through a heat receiving chamber. The heat absorbed by the heat exchanging liquid may be used for warming, for example, the air in an object to be warmed. The viscous fluid type heat generator of the present invention may be advantageously used as a heat generating source incorporated in, for example, a heating system or a climate control system of an automobile.

2. Description of the Related Art

U.S. Pat. No. 4,993,377 to Itakura discloses an automobile heating apparatus in which a viscous fluid type heat generator is incorporated. The viscous fluid type heat generator described in U.S. Pat. No. '377 includes a pair of mutually opposing front and rear housings tightly secured together by through-bolts to define an inner heat generating chamber and a heat receiving chamber separated by a partition wall through which the heat is exchanged between the viscous fluid in the heat generating chamber and the water in the heat receiving chamber. The heat receiving chamber is therefore arranged to be located outside but close to the heat generating chamber. The heat exchanging water is introduced into the heat receiving chamber through a water inlet port and delivered from the heat receiving chamber toward an external heating system, and the water is constantly circulated through the heat generator and the external heating system.

A drive shaft is rotatably supported in the front housing via an anti-friction bearing so as to support thereon a rotor element in such a manner that the rotor element is rotated with the drive shaft within the heat generating chamber. The rotor element has outer faces which are in face-to-face relationship with the wall faces of the heat generating chamber and form labyrinth grooves therebetween, and a viscous fluid, for example, silicon oil is supplied into the heat generating chamber so as to fill the labyrinth grooves between the rotor and the wall faces of the heating cheer.

When the viscous fluid type heat generator is incorporated in the heating system of an automobile, the heat generator per se is accommodated in a mounting space extending around an engine crank shaft so as to be operatively connected to the automobile engine. Therefore, the drive shaft of the viscous fluid type heat generator is rotated to rotate the rotor element within the heat generating chamber while applying a shearing action to the viscous fluid in the heating chamber. Thus, the viscous fluid generates heat when being sheared, and a heat exchange is conducted between the viscous liquid within the heat generating chamber and the water flowing through the heat receiving chamber. The heated water is circulated through the heating system of the automobile to warm the compartment within the automobile.

In the above-described conventional viscous fluid type heat generator, the rotor element is generally formed as a disc-like element including a central boss portion by which the rotor element is mounted on the drive shaft, and a circular heat generating portion extending around the boss portion and acting on the viscous liquid to generate heat. The circular heat generating portion has, with respect to the axis of rotation of the drive shaft, a radius which is larger than an axial length of the central boss portion. Specifically, in order to ensure generation of a large amount of heat, the diameter of the circular heat generating portion of the rotor element must be large enough to form a large heat generating surface on the opposite side of the rotor element, and accordingly, the dimension of the conventional viscous fluid type heat generating apparatus in a plane perpendicular to the axis of rotation of the drive shaft is appreciably large. As a result, it is difficult to acquire a mounting space within an engine compartment which permits the viscous fluid type heat generating apparatus to be adequately mounted so as to receive a drive power from an automobile engine, although the automobile engine generally provides a limited amount of mounting space extending laterally and adjacently to the crankshaft thereof.

SUMMARY OF THE INVENTION

An object of the present invention is to provide a viscous type heat generator constructed so as to be mounted in the existing mounting space extending laterally and adjacently to the crankshaft without sacrificing the heat generating performance of the heat generator.

Another object of the present invention is to provide a viscous type heat generator in which novel cylindrically extending heat generating and receiving chambers are provided by adopting an axially elongated rotor element.

A further object of the present invention is to provide a reduced weight and simply manufactured viscous type heat generator.

In accordance with the present invention, there is provided a viscous fluid type heat generator which comprises:

a cylindrical housing assembly defining therein a cylindrical chamber;

a drive shaft rotatably mounted in the cylindrical housing assembly and having a substantial portion extending axially through the cylindrical chamber and an end portion extending from the substantial portion for receiving a drive force;

an axially elongated rotor element mounted on the substantial portion of the drive shaft to be rotated therewith within the cylindrical chamber of the housing assembly, the elongated rotor element having an outer surface portion to define, within the cylindrical chamber of the housing assembly, a heat generating chamber and a heat receiving chamber fluidly separated from one another by a separating means, the heat generating chamber having inner walls thereof;

a liquid passage means for allowing a heat exchanging liquid to flow through the heat receiving chamber;

viscous fluid supplied in a space extending between the inner walls of the heat generating chamber and the outer surface portion of the elongated rotor element to generate heat in response to rotation of the elongated rotor element; and wherein the outer surface portion of the elongated rotor element includes a cylindrical surface portion having a predetermined radius "R" and a predetermined axial length "L" which are designed to satisfy such a dimensional relationship therebetween that the predetermined axial length "L" is larger than the radius "R".

Preferably, the heat receiving chamber is only defined around the cylindrical surface portion of the elongated rotor element.

Preferably, the separating means includes a cylindrical annular element arranged between the heat generating chamber and the heat receiving chamber, and having a spirally extending rib formed in an outer circumference of the cylindrical annular element and arranged in the heat receiving chamber so as to define a spirally extending fluid flow passage through which the heat exchanging liquid flows in the liquid passage means.

The liquid passage means may include a liquid inlet port for introducing the heat exchanging liquid into the heat receiving chamber for receiving heat from the heat generating chamber, and a liquid outlet port for delivering the heat exchanging liquid from the heat receiving chamber after receiving the heat. Preferably, the liquid inlet and liquid outlet ports are provided so as to lie in a common plane extending to contain the axis of rotation of the drive shaft, so that production of the liquid inlet and outlet can be continuously achieved by a workman without changing a position of the housing assembly. Thus, the production of the viscous fluid type heat generator per se can be simplified. Further, the arrangement of the liquid inlet and outlet ports in the common plane may also contribute to simplifying the piping for the heat exchanging liquid, typically water, in a restricted space in the engine compartment.

Preferably, the elongated rotor element is a hollow cylindrical element typically made of an aluminum alloy material. Thus, the elongated rotor element can contribute to a reduction in the weight of the viscous fluid type heat generator. Further, the elongated rotor element is fixedly mounted on the drive shaft by a press-fitting method.

BRIEF DESCRIPTION OF THE DRAWING

The above and other objects, features and advantages of the present invention will be made more apparent from the ensuing description of a preferred embodiment thereof in conjunction with the accompanying drawings wherein.

DESCRIPTION OF THE PREFERRED EMBODIMENT

Figure 1:
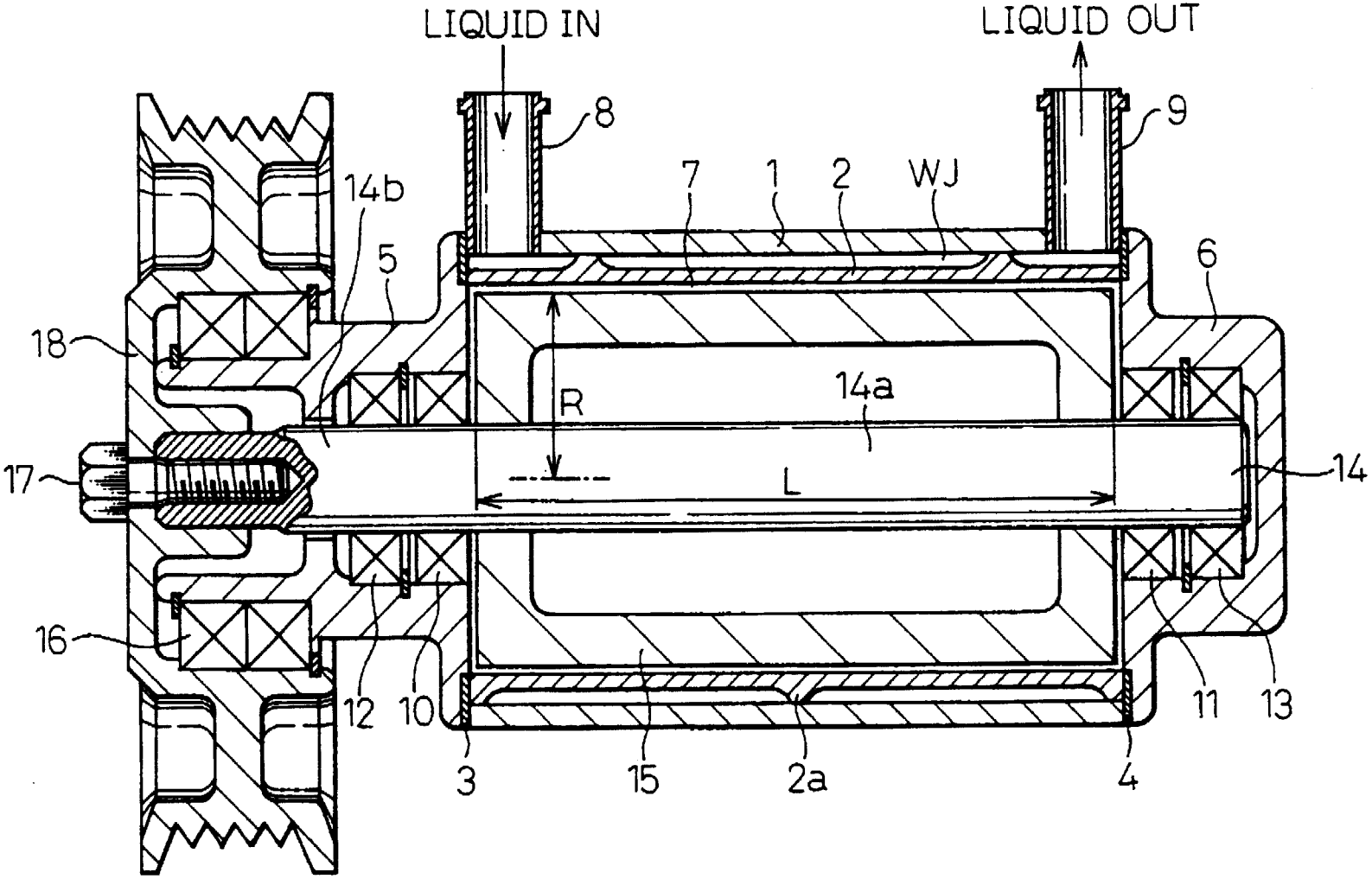
FIG. 1 is a longitudinal cross-sectional view of a viscous fluid type heat generator according to an embodiment of the present invention.

Referring to FIG. 1, a viscous fluid type heat generator has a housing assembly including a middle housing 1 in the shape of a cylindrical hollow member, and a hollow cylinder block 2 press-fitted in the middle housing 1. The middle housing 1 and the cylinder block 2 have substantially the same axial length to form a front end on the left side in FIG. 1 and an opposite rear end. The housing assembly further includes a front housing 5 tightly attached to the front end of the middle housing 1 and the cylinder block 2 via a front sealing gasket 3, and a rear housing 6 tightly attached to the rear end of the middle housing 1 and the cylinder block 2 via a rear sealing gasket 4. Thus, the housing assembly defines a cylindrical chamber formed therein in which a later-described rotor element 15 is received. The housing assembly is provided with a heat generating chamber 7 inside the cylinder block 2, formed by spacings extending between an inner wall of the cylinder block 2 and the rotor element 15, and also extending between axial ends of the rotor element 15 and inner end walls of the front and rear housings 5 and 6.

The housing assembly is also provided with a heat receiving chamber WJ extending between a cylindrical inner wall of the middle housing 1 and a substantially cylindrical outer circumference of the cylinder block 2. At this stage, the cylinder block 2 is provided with a rib **2*a* integrally formed in the outer circumference thereof which spirally and continuously extends from a position close to the front end of the housing assembly to another position close to the rear end of the housing assembly. As the spirally extending rib 2*a* extends from the outer circumference of the cylinder block 2 toward the inner wall of the middle housing 1, it defines, in the heat receiving chamber WJ, a spirally extending fluid passage permitting a heat exchanging liquid to flow therethrough while receiving heat from the heat generating chamber 7. In order to promote the heat receiving by the heat exchanging liquid, heat exchanging fins may be provided so as to extend from either the cylindrical inner wall of the middle housing 1 or the outer circumference of the cylinder block 2 into the heat receiving chamber WJ. The fins can increase the surface area of the outer circumference of the cylinder block being in contact with the heat exchanging liquid, and accordingly, an increase in transmission efficiency of heat from the heat generating chamber 7 to the heat exchanging liquid flowing in the heat receiving chamber WJ through the outer circumference of the cylinder block 2 can be achieved. It should be noted that the rib 2*a* of FIG. 1** also functions as heat exchanging fins.

An inlet port 8 for introducing the heat exchanging liquid, typically water, into the heat receiving chamber WJ from an external heating circuit (not shown in FIG. 1) is provided at a portion of the middle housing 1. In the present embodiment, the inlet port 8 is arranged at a position adjacent to the front end of the middle housing 1. Also, an outlet port 9 for delivering the heat exchanging liquid from the heat receiving chamber WJ into the external heating circuit is provided at another portion of the middle housing 1, i.e., at a position adjacent to the rear end of the middle housing 1. The inlet and outlet ports 8 and 9 are arranged in a common plane intersecting the outer circumference of the middle housing 1, and are formed by tubular elements having an inner passageway therein fluidly communicating with the heat receiving chamber WJ. The above-mentioned common plane is, preferably, a plane containing therein an axis rotation of the drive shaft 14. The arrangement of the inlet and outlet ports 8 and 9 in the common plane can make it easier to produce them by using the tubular members. This is because two through-holes in the outer circumference of the middle housing 1 in which the tubular members of the inlet and outlet ports 8 and 9 are tightly fitted can be bored by a machine tool without changing the position of the middle housing 1.

The housing assembly is further provided with shaft sealing devices 10 and 11, and anti-friction bearings 12 and 13 for rotatably supporting a drive shaft 14. The drive shaft 14 has a substantial axial portion **14*a* and an extending portion 14*b*. The substantial portion 14*a* of the drive shaft 14 extends through the cylindrical chamber of the housing assembly and supports thereon the rotor element 15 in the shape of an axially elongated hollow cylindrical member. Preferably, the elongated rotor element 15 is press-fitted onto the substantial portion 14*a* of the drive shaft 14 so as to be rotated together. Alternately, the rotor element 15 may be attached to the drive shaft 14 by an adhesive as required. Further, the elongated hollow rotor element 15** may preferably be made of aluminum alloy by the method of die casting.

An outer circumference of the elongated rotor element 15 and the inner wall of the cylinder block 2 define a major portion of the heat generating chamber 7 having the shape of an annular space extending cylindrically around the outer circumference of the rotor element 15.

The outer circumference of the rotor element 15 has a radius "R" with respect to the axis of rotation of the drive shaft 14, and an axial length "L", as shown in FIG. 1. The outer circumference of the elongated rotor element 15 and/or the inner wall of the cylinder block 2 may be recessed to form labyrinth grooves in the heat generating chamber 7.

The heat generating chamber 7 including an annular space extending between the outer circumference of the elongated rotor element 15 and the inner wall of the cylinder block 2, and respective circular spaces extending between the end walls of the front and rear housings 5 and 6 and the front and rear end walls of the rotor element 15 is filled with viscous liquid consisting of silicon oil. At this stage, the heat generating chamber 7 should not be entirely filled with the silicon oil but is filled with a mixture of the silicon oil and the air having a volumetric rate of 80% of silicon oil and 20% of the air so that even if the viscous fluid is thermally expanded, leaking or oozing of the silicon oil from the heat generating chamber 7 can be prevented.

From the foregoing description, it will be understood that the viscous fluid type heat generator according to the embodiment of the present invention is provided with the elongated hollow rotor element incorporated in the hollow housing assembly and having a relatively small diameter but a necessary axial length. Therefore, the elongated rotor element has a large cylindrical outer surface acting as a viscous liquid holding surface. Therefore, the heat generator of the present invention can perform a heat generating function surely comparable with the conventional viscous liquid type heat generator employing a disc-type rotor element, and can be a very low weight heat generator.

Further, the drive shaft 14 has mounted thereon a pulley member 18 secured to an outermost end of the drive shaft 14 by a screw bolt 17. The pulley member 18 is also rotatably supported on a frontmost end of the front housing 5 via anti-friction bearings 16 as clearly shown in FIG. 1.

Figure 2:
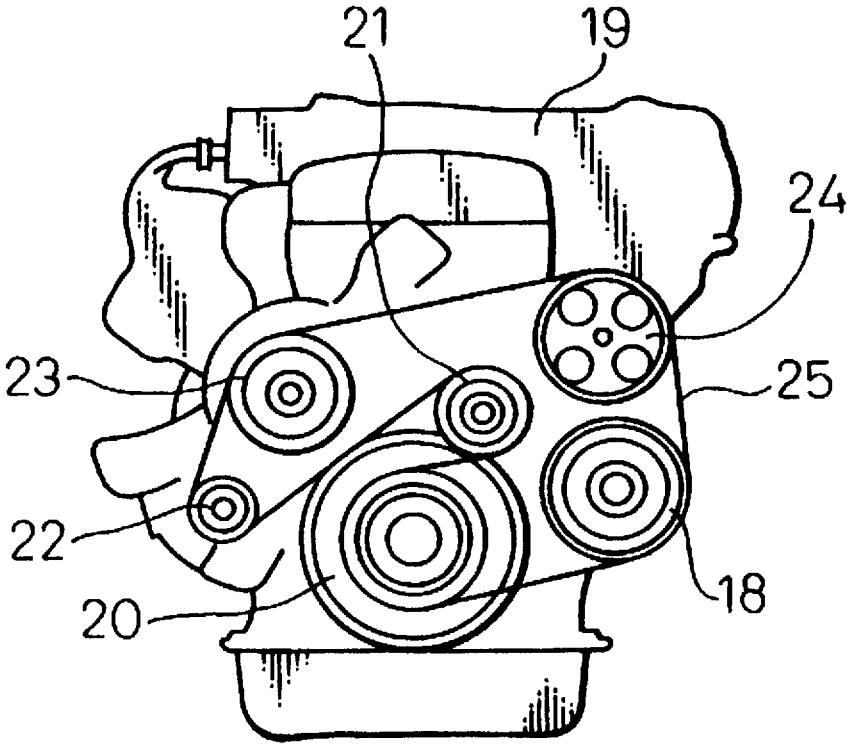
FIG. 2 is a schematic view of an automobile engine, illustrating an outer view of the engine on which various auxiliary equipments including the viscous fluid type heat generator of the present invention are mounted to be driven by the engine.

The above-described viscous fluid type heat generator is mounted on an automobile engine 19 so as to be received in the existing mounting space extending laterally and adjacently to a crankshaft (not appearing in FIG. 2) of the engine 19. The crankshaft of the engine 19 has a crankshaft pulley 20 fixed to its outermost end. Thus, the crankshaft of the engine 19 drives the pulley member 18 of the viscous fluid type heat generator via the pulley 20 and a belt 25 engaged with the pulley 20. The crankshaft of the engine 19 also drives an idler pulley 21, an alternator pulley 22, a water pump pulley 23, and a power steering pulley 24.

When the drive shaft 14 of the viscous fluid type heat generator is rotatively driven by the engine 19 via the pulley element 18, the elongated rotor element 15 rotates in the heat generating chamber 7. Therefore, the silicon oil existing in the spacings between the outer circumference of the elongated rotor element 15 and the inner walls of the heat generating chamber 7 is subjected to a shearing action in response to the rotation of the rotor element 15, and generates heat. The generated heat of the silicon oil is transmitted through the cylinder block 2 to the heat exchanging liquid, e.g. water, in the heat receiving chamber WJ. At this stage, the heat exchanging liquid flows from the external heating circuit of the automobile climate control system into the heat receiving chamber WJ via the inlet port 8, flows in the spiral flow passage with the same chamber WJ while absorbing the heat, and flows out of the heat receiving chamber WJ via the outlet port 9 toward the external heating circuit for warming the automobile passenger compartment. The spiral flow passage of the heat receiving chamber WJ is effective for forming a stable and .smooth flow of the heat exchanging liquid without any stagnation and shortcircuiting, and accordingly, an effective heat absorption by the heat exchanging liquid can be achieved.

When it is assumed that the viscosity of the silicon oil filled in the heat generating chamber is $\mu$, the radius of the elongated rotor element 15 is R, the axial length of the same rotor element is L, the space between the inner walls of the heat receiving chamber WJ and the outer circumference of the rotor element is $\delta$, and an angular velocity of the rotating elongated rotor element is $\omega$, an amount of heat $L_1$ generated at both front and rear ends of the rotating elongated rotor element 15, and an amount of heat $L_2$ generated at the outer circumference of the same rotor element 15 can be defined by equations (1) and (2) as set forth below.

$$L_1=\pi\mu\omega R^4/\delta \quad (1)$$

$$L_2=2\pi\mu\omega R^{3L}/\delta \quad (2)$$

In the viscous fluid type heat generator, since the radius R of the elongated rotor element 15 is smaller than the axial L of the same rotor element 15, $L_2$ is larger than $L_1$. Namely, the outer circumference of the elongated rotor element 15 generates a major part of the heat corresponding to the amount of heat $L_2$. Thus, the viscous fluid type heat generator according to the embodiment of the present invention has a smaller outer diameter but a larger axial length compared with the conventional viscous fluid type heat generator as disclosed in U.S. Pat. No. 4,993,377. However, the axial length L of the elongated rotor element 15 must be determined by considering that the heat generator must be mounted and received in the existing mounting space near the automobile engine. It should be understood that with the construction of the viscous fluid type heat generator of the present invention, the heat receiving chamber WJ is formed only around the outer circumference of the rotor element 15 and is not formed at both ends of the rotor element 15 so as to prevent the axial length of the rotor element 15 from being added. Thus, the viscous fluid type heat generator of the present invention generates heat of which the amount corresponds to $L_1+L_2$ determined by the above-mentioned equations (1) and (2) and is comparable with the conventional heat generator with the disc-like rotor element. Further, the viscous fluid type heat generator of the present invention can be mounted and located in the existing mounting space extending laterally and adjacently to the crankshaft of the automobile engine.

Further, as previously described, the arrangement of the inlet and outlet ports 8 and 9 in a common plane intersecting the outer circumference of the housing assembly contributes to an easy production of the heat generator and an easy piping arrangement for the heat exchanging liquid within a small engine compartment of automobiles. Moreover, since the heat generator has a generally hollow construction, the weight of the entire heat generator can be small.

From the foregoing, it will be understood that according to the present invention, the viscous fluid type heat generator can be of a low weight and low cost while having a heat generating function comparable with the conventional viscous liquid type heat generator. Many variations and modifications to the described embodiments will occur to persons skilled in the art without departing from the scope and spirit of the present invention as claimed in the accompanying claims.

What we claim is:

1. A viscous fluid type heat generator comprising: a cylindrical housing assembly defining therein a cylindrical chamber; a drive shaft rotatably mounted in said cylindrical housing assembly and having a substantial portion extending axially through said cylindrical chamber and an end portion extending from said substantial portion for receiving a drive force; an axially elongated rotor element mounted on said substantial portion of said drive shaft to be rotated therewith within said cylindrical chamber of said housing assembly, said elongated rotor element having an outer surface portion to define, within said cylindrical cheer of said housing assembly, a heat generating chamber and a heat receiving chamber fluidly separated from one another by a separating means, said heat generating chamber having inner walls thereof; a liquid flowing means for forming a flow of a heat exchanging liquid through said heat receiving chamber; viscous fluid being supplied in a space extending between said inner walls of said heat generating chamber and said outer surface portion of said elongated rotor element to generate heat in response to the rotation of said elongated rotor element; and wherein said outer surface portion of said elongated rotor element includes an axially continuous cylindrical surface portion having a predetermined radius "R" and a predetermined axial length "L" which are designed to satisfy such a dimensional relationship therebetween so that "L" is larger than "R", whereby said heat generating chamber comprises a cylindrical heat generating portion defined by said inner walls thereof and the axially continuous cylindrical surface portion of said elongated rotor element.

2. A viscous fluid type heat generator according to claim 1, wherein said heat receiving chamber is defined only around said axially continuous cylindrical surface portion of said elongated rotor element.

3. A viscous fluid type heat generator according to claim 1, wherein said separating means includes a cylindrical annular element arranged between said heat generating chamber and said heat receiving chamber, and having a spirally extending rib formed in an outer circumference thereof, said rib being arranged in said heat receiving chamber so as to define a spirally extending fluid flow passage through which the heat exchanging liquid is flown by said liquid passage means.

4. A viscous fluid type heat generator according to claim 1, wherein said liquid passage means include a liquid inlet port means for introducing the heat exchanging liquid into said heat receiving chamber for receiving heat from said heat generating chamber, and a liquid outlet port means for delivering the heat exchanging liquid from said heat receiving chamber after receiving the heat.

5. A viscous fluid type heat generator according to claim 4, wherein said liquid inlet and liquid outlet port means are provided so as to lie in a common plane extending so as to contain therein an axis of rotation of said drive shaft.

6. A viscous fluid type heat generator according to claim 5, wherein said inlet and outlet port means are axially spaced from each other and arranged at respective positions adjacent to axially opposite ends of said housing assembly.

7. A viscous fluid type heat generator according to claim 1, wherein said elongated rotor element comprises a hollow cylindrical element.

8. A viscous fluid type heat generator according to claim 7, wherein said hollow cylindrical element of said elongated rotor element is made of aluminum alloy material.

9. A viscous fluid type heat generator according to claim 1, wherein said elongated rotor element is press-fitted onto said substantial portion of said drive shaft.

10. A viscous fluid type heat generator according to claim 1, wherein said end portion extending from said substantial portion of said drive shaft has a pulley element fixed thereto and receiving a rotational drive power from an automobile engine when said viscous fluid type heat generator is mounted and arranged in a mounting space extending laterally and adjacently to a crankshaft of said engine.

11. A viscous fluid type heat generator according to claim 1, wherein said heat generating chamber comprises:

a main heat generating chamber in the shape of an annular space extending between an outer cylindrical circumference of said elongated rotor element and said separating means; and a secondary heat generating chamber in the shape of circular space extending between at least one of the opposite ends of said elongated rotor element and an inner wall of said housing assembly.

12. A viscous fluid type heat generator according to claim 1, wherein said heat receiving chamber is arranged adjacent to said cylindrical heat generating chamber of said elongated rotor element so that said heat receiving chamber is formed as an axially elongated chamber.

13. A viscous fluid type heat generator according to claim 12, wherein said heat receiving chamber has a flow passage for allowing the heat exchanging liquid to flow in a specific direction in said heat receiving chamber.

14. A viscous fluid type heat generator according to claim 13, wherein said flow passage is defined by a rib arranged in said heat receiving chamber so that flow passage extends spirally around said cylindrical heat generating chamber.

* * * * *

UNITED STATES PATENT AND TRADEMARK OFFICE

CERTIFICATE OF CORRECTION

PATENT NO. : 5,704,320
DATED : January 6, 1998
INVENTOR(S) : Takashi BAN, et al

It is certified that error appears in the above-identified patent and that said Letters Patent is hereby corrected as shown below:

The word "silicon" should be corrected to read "silicone" in the following instances:

column 1, line 44; column 5, lines 15, 17, (both occurrences) 18, 20, and 54;

column 6, line 7.

The following corrections should also be made:

column 5, line 22: insert a comma after "description";
column 6, line 62: replace "the" by --a--;

Signed and Sealed this
First Day of February, 2000

*Attest:*

*Attesting Officer*

Q. TODD DICKINSON

*Acting Commissioner of Patents and Trademarks*